US012290740B2

(12) United States Patent
Pellegrino

(10) Patent No.: US 12,290,740 B2
(45) Date of Patent: May 6, 2025

(54) EXERCISE GRIP

(71) Applicant: VICTORY GRIPS LLC, Tybee Island, GA (US)

(72) Inventor: Victor Brian Pellegrino, Tybee Island, GA (US)

(73) Assignee: VICTORY GRIPS LLC, Tybee Island, GA (US)

( * ) Notice: Subject to any disclaimer, the term of this patent is extended or adjusted under 35 U.S.C. 154(b) by 19 days.

(21) Appl. No.: 16/921,235

(22) Filed: Jul. 6, 2020

(65) Prior Publication Data

US 2021/0023435 A1 Jan. 28, 2021

Related U.S. Application Data

(63) Continuation of application No. 15/842,678, filed on Dec. 14, 2017, now Pat. No. 10,702,761, which is a continuation-in-part of application No. 15/589,354, filed on May 8, 2017, now Pat. No. 10,576,356, which is a continuation of application No. 14/644,512, filed on Mar. 11, 2015, now Pat. No. 9,643,073.

(60) Provisional application No. 61/951,872, filed on Mar. 12, 2014.

(51) Int. Cl.

| | |
|---|---|
| ***A63B 71/14*** | (2006.01) |
| ***A63B 26/00*** | (2006.01) |
| *A63B 21/00* | (2006.01) |

(52) U.S. Cl.

CPC ..... *A63B 71/14* (2013.01); *A63B 26/00* (2013.01); *A63B 71/141* (2013.01); *A63B 21/4001* (2015.10); *A63B 21/4019* (2015.10); *A63B 21/4021* (2015.10); *A63B 2209/00* (2013.01); *A63B 2209/10* (2013.01); *A63B 2244/09* (2013.01)

(58) Field of Classification Search

CPC ..... A63B 1/00; A63B 7/00; A63B 21/4019; A63B 21/4021; A63B 71/14; A63B 71/141

See application file for complete search history.

(56) References Cited

U.S. PATENT DOCUMENTS

| | | | | | |
|---|---|---|---|---|---|
| 1,126,938 | A * | 2/1915 | Barrett | G09B 15/06 | 601/40 |
| 1,200,580 | A * | 10/1916 | Brenner | A63B 71/146 | 2/161.3 |
| 2,456,678 | A | 12/1948 | Dana | | |
| 2,566,580 | A | 9/1951 | Patterson | | |
| 2,769,179 | A * | 11/1956 | Love | F41B 5/1473 | D29/113 |
| 3,178,724 | A | 4/1965 | Perschke | | |
| 3,421,160 | A * | 1/1969 | Domenico | A63B 71/148 | 473/59 |
| 3,501,773 | A * | 3/1970 | Stansberry | A63B 71/148 | 473/59 |

(Continued)

*Primary Examiner* — Joshua Lee

(74) *Attorney, Agent, or Firm* — Fish & Richardson P.C.

(57) ABSTRACT

Exercise grip and methods of forming exercise grips are disclosed. In one aspect, an exercise grip includes a wrist strap and a protective portion. The protective portion has a palm end and a finger end. The palm end is located closer to the wrist strap than the finger end. The finger end is formed offset from a centerline axis of the palm end of the protective portion.

15 Claims, 14 Drawing Sheets

(56) References Cited

U.S. PATENT DOCUMENTS 3,564,613 A * 2/1971 Fowler ..... A41D 13/088 473/59
4,701,963 A 10/1987 Overton
4,720,279 A 1/1988 Fritschen et al.
4,785,478 A * 11/1988 Mosley ..... A41D 13/084 2/167
4,793,005 A * 12/1988 Hetzel, Jr. ..... A41D 19/01547 482/106
5,033,119 A * 7/1991 Wiggins ..... A63B 71/146 2/161.3
5,079,776 A * 1/1992 Crawford ..... A63B 71/141 2/167
5,195,188 A 3/1993 Bourdeau et al.
5,197,149 A 3/1993 Overton
5,261,299 A * 11/1993 Kondos ..... A41D 19/01594 81/355
5,298,001 A * 3/1994 Goodson ..... A63B 21/4021 2/161.1
D348,090 S * 6/1994 Riley, Jr. ..... D29/116.1
5,350,343 A 9/1994 DaSilva
5,353,440 A 10/1994 Meldeau
5,423,089 A * 6/1995 Chun ..... A63B 71/146 2/907
5,459,883 A * 10/1995 Garceau-Verbeck ..... A63B 71/146 2/161.4
5,513,391 A 5/1996 Garneau et al.
5,634,213 A 6/1997 Grover
5,704,883 A 1/1998 Eckmann
5,740,555 A 4/1998 Renegar
5,813,950 A 9/1998 Parker
5,898,944 A * 5/1999 Vrany ..... A41D 19/01547 2/163
5,924,136 A * 7/1999 Ogean ..... A45C 1/04 2/163
6,035,443 A * 3/2000 Green ..... A63B 71/146 2/907
6,119,267 A * 9/2000 Pozzi ..... A63B 71/145 2/161.1
6,553,576 B1 * 4/2003 Knapp ..... A41D 19/01547 2/163
6,666,795 B2 12/2003 Mah
6,834,397 B1 12/2004 Murphy
7,334,711 B1 * 2/2008 Winters ..... H04B 1/385 224/217
7,475,433 B2 * 1/2009 Coulter ..... A63B 71/141 2/160
8,060,948 B2 * 11/2011 Pesic ..... A45F 5/00 2/163
8,726,418 B2 5/2014 DeBlasis et al.
8,925,113 B2 * 1/2015 Fricke ..... A63B 71/141 2/161.1
9,067,123 B1 * 6/2015 Robbins ..... A41D 19/01547
D741,974 S * 10/2015 Lung ..... D21/698
9,339,693 B1 5/2016 Pegram et al.
9,380,817 B1 * 7/2016 Drake ..... A41D 13/082
9,643,073 B1 5/2017 Pellegrino
D823,573 S * 7/2018 Delarosa ..... D2/617
10,576,356 B1 3/2020 Pellegrino
10,702,761 B2 7/2020 Pellegrino
10,835,804 B1 11/2020 Pellegrino
2004/0018899 A1 1/2004 Thiruppathi
2004/0244088 A1 12/2004 Greenhalgh
2006/0026738 A1 * 2/2006 Kleinert ..... A63B 71/143 2/163
2008/0263747 A1 * 10/2008 DeBlasis ..... A41F 1/06 2/163
2010/0043113 A1 * 2/2010 Clark ..... A41D 13/082 2/20
2014/0373247 A1 * 12/2014 Swaby ..... A63B 71/14 2/69
2018/0140929 A1 5/2018 Pellegrino
2021/0170258 A1 6/2021 Pellegrino

* cited by examiner

EXERCISE GRIP

CROSS-REFERENCE TO RELATED APPLICATIONS

This application is a continuation application of, and claims priority to, U.S. patent application Ser. No. 15/842,678, now Pat. No. 10,702,761, entitled "EXERCISE GRIP," filed on Dec. 14, 2017, which is a continuation in part of, and claims priority to, U.S. patent application Ser. No. 15/589,354, entitled "EXERCISE GRIP," filed May 8, 2017, which is a continuation application of, and claims priority to, U.S. patent application Ser. No. 14/644,512, now U.S. Pat. No. 9,643,073, entitled "EXERCISE GRIP," filed on Mar. 11, 2015, which claims the benefit under 35 U.S.C. § 119(e) of U.S. Provisional Patent Application No. 61/951,872, entitled "EXERCISE GRIP," filed Mar. 12, 2014. The disclosure of the foregoing applications are incorporated herein by reference in their entirety for all purposes.

BACKGROUND

This specification relates to an exercise grip. There are many different exercise movements that can result in injury to hands. Some of these exercises are performed on horizontal bars and gymnastics rings. During these exercises skin that is in contact with the bars or rings experience friction that can lead to injury. Exercise grips can help protect hands from injuries when performing various exercise movements.

SUMMARY

In general, one innovative aspect of the subject matter described in this specification can be embodied in an exercise grip that includes a wrist strap; and a protective portion that has a palm end and a finger end, wherein the palm end is located closer to the wrist strap than the finger end, and the finger end is formed offset from a centerline axis of the palm end of the protective portion.

These and other embodiments can each optionally include one or more of the following features.

A width of the palm end of the protective portion can be larger than the width of the finger end of the protective portion.

A friction axis can be defined by an angled friction protection section of the protective portion, wherein the friction axis intersects the centerline axis of the palm end and a finger end axis that is defined between two finger holes of the finger end, wherein the finger end axis is parallel to the centerline axis of the palm end, and wherein the friction axis is not perpendicular to the centerline axis of the palm end. The width of the protective portion can be most narrow at a location within the angled friction protection section. The finger end axis can be perpendicular to a wrist strap axis that is defined by a largest dimension of the wrist strap. The palm end centerline axis can be perpendicular to the wrist strap axis and bisects the palm end of the protective portion. The protective portion can be a single piece of material that extends from the palm end to the finger end. The protective portion can include a side palm protection area that extends from the wrist strap toward the finger end and is located on an opposite side of the centerline axis of the palm end than the two finger holes. The angled friction protection section can have a width that varies long the length of the angled friction protection section.

A first concave segment of a first side of the protective portion can have a concave shape between the wrist strap and the finger end; and A first convex segment of a second side of the protective portion can have a convex shape between the wrist strap and the finger end.

The first side of the protective portion can have the first concave segment and a second convex segment that are both between the palm end and the finger end; and The second side of the protective portion can have a second concave segment and the first convex segment that are both between the palm end and the finger end.

The protective portion can have two finger holes that are defined at a location of the protective portion that is closer to the finger end than the palm end. One side of the protective portion narrows at a given segment that is adjacent to the two finger holes relative to the width of the protective portion that is closer to the palm end.

At least a portion of the wrist strap and the protective portion can both be formed using a same piece of continuous material. A portion of the wrist strap can have two holes defined therein. The portion of the wrist strap having the two holes defined therein can be folded over to align the two holes. The two holes can be defined to receive an opposite end of the wrist strap when aligned.

Two sides of the protective portion that extend from the palm end to the finger end can be asymmetric and cover only a portion of the palm when placed on a hand.

The grip can have a dowel area that is located between the finger holes and the palm end.

In general, another aspect of the subject matter described in this specification can be embodied in methods that include the actions of forming a wrist strap and forming a protective portion. The protective portion is formed to have a palm end and a finger end. The palm end is located closer to the wrist strap than the finger end. The finger end is formed offset from a centerline axis of the palm end of the protective portion.

A width of the palm end of the protective portion can be formed to be larger than the width of the finger end of the protective portion.

A friction axis can be defined by an angled friction protection section of the protective portion, wherein the friction axis intersects the centerline axis of the palm end and a finger end axis that is defined between two finger holes of the finger end, wherein the finger end axis is parallel to the centerline axis of the palm end, and wherein the friction axis is not perpendicular to the centerline axis of the palm end.

The width of the protective portion can be formed to be most narrow at a location within the angled friction protection section.

The protective portion can be formed so that the finger end axis is perpendicular to a wrist strap axis that is defined by a largest dimension of the wrist strap, and the palm end centerline axis is perpendicular to the wrist strap axis and bisects the palm end of the protective portion.

The protective portion can be formed from a single piece of material that extends from the palm end to the finger end;

The protective portion can be formed to include a side palm protection area that extends from the wrist strap toward the finger end and is located on an opposite side of the centerline axis of the palm end than the two finger holes.

The angled friction protection section can be formed to have a width that varies long the length of the angled friction protection section.

The protective portion can be formed to include a first concave segment of a first side of the protective portion that has a concave shape between the wrist strap and the finger end; and The protective portion can be formed with a first convex segment of a second side of the protective portion having a convex shape between the wrist strap and the finger end.

The first side of the protective portion can be formed to have the first concave segment and a second convex segment that are both between the palm end and the finger end; and The second side of the protective portion can be formed to have a second concave segment and the first convex segment that are both between the palm end and the finger end.

Methods can include forming two finger holes in the protective portion, wherein the two finger holes are formed at a location of the protective portion that is closer to the finger end than the palm end.

Forming the protective portion can include forming the protective portion to have one side of the protective portion that narrows at a given segment that is adjacent to the two finger holes relative to the width of the protective portion that is closer to the palm end.

At least a portion of the wrist strap and the protective portion can both be formed using a same piece of continuous material. A portion of the wrist strap can have two holes defined therein. The portion of the wrist strap having the two holes defined therein can be folded over to align the two holes. The two holes can be defined to receive an opposite end of the wrist strap when aligned.

Two sides of the protective portion that extend from the palm end to the finger end can be formed to be asymmetric and cover only a portion of the palm when placed on a hand.

Methods can include forming a dowel area that is located between the finger holes and the palm end of the protective portion.

Another innovative aspect of the subject matter described in this specification can be embodied in an exercise grip that includes a wrist strap; and a protective portion connected to the wrist strap at a wrist end of the protective portion, a finger end of the protective portion having three finger holes defined therein the protective portion having a length that extends from the finger end to the wrist end and a width that varies along the length of the protective portion, wherein the wrist end has a first width that covers an ulnar side of a wrist and is larger than a second width of the finger end, and wherein a width of the protective portion that is between the finger end and the wrist end has a third width that is smaller than the second width. The first width of the wrist end can be larger than the third width of the finger end.

These and other embodiments can each optionally include one or more of the following features. The three finger holes can include a middle finger hole, a ring finger hole and a pinky finger hole, and wherein the middle finger hole, ring finger hole, and pinky finger hole are defined at locations at which a middle finger, ring finger, and pinky finger are respectively received when the exercise grip is placed on a hand.

The middle finger hole can be at a first distance from the wrist end, the ring finger hole is at a second distance from the wrist end, and the little finger hole is at a third distance from the wrist end. The first distance can be larger than the second distance and the second distance is larger than the third distance.

The protective portion can be a continuous flexible material. The flexible material can be at least one of leather, neoprene, or rubber.

Other embodiments of this aspect include corresponding methods for making an exercise grip. Methods can include the actions of forming a protective portion of an exercise grip, wherein the protective portion is formed to have a wrist end and a finger end, the finger end having three finger holes defined therein and the protective portion having a length that extends from the finger end to the wrist end, the protective portion having a width that varies along the length of the protective portion, wherein the wrist end has a first width that covers an ulnar side of a wrist and is larger than a second width of the finger end, and wherein a width of the protective portion between the finger end and the wrist end has a third width that is smaller than the second width; and connecting the protective portion to a wrist strap.

These and other embodiments can each optionally include one or more of the following features. Forming the protective portion can include forming the three finger holes in the finger end, the three finger holes comprising a middle finger hole, a ring finger hole, and a pinky finger hole.

Forming the three finger holes can include forming the middle finger hole, ring finger hole, and pinky finger hole at locations at which a middle finger, ring finger, and pinky finger are respectively received when the exercise grip is placed on a hand.

Forming the three finger holes can include forming the middle finger hole at a first distance from the wrist end; forming the ring finger hole at a second distance from the wrist end; and forming the little finger hole at a third distance from the wrist end. The first distance can be larger than the second distance and the second distance is larger than the third distance. The first width of the wrist end can be larger than the third width of the finger end.

Forming the protective portion can include forming the protective portion from a continuous piece of flexible material. The flexible material can be at least one of leather, neoprene, or rubber.

Methods can optionally include forming a fourth finger hole at a location of the protective portion at which an index finger is received when the grip is placed on a hand.

Another innovative aspect of the subject matter described in this specification can be embodied in an exercise grip that includes a wrist strap; and a protective portion connected to the wrist strap at a wrist end of the protective portion, a finger end of the protective portion having three finger holes defined therein the protective portion having a length that extends from the finger end to the wrist end and a width that varies along the length of the protective portion.

Another innovative aspect of the subject matte described in this specification can be embodied in an exercise grip including a wrist strap; and a protective portion connected to the wrist strap at a wrist end of the protective portion, a finger end of the protective portion having four finger holes defined therein the protective portion having a length that extends from the finger end to the wrist end and a width that varies along the length of the protective portion. The four finger holes can be formed at locations at which an index finger, a middle finger, a ring finger, and a pinky finger are respectively received when the grip is placed on a hand.

Particular embodiments of the subject matter described in this specification can be implemented so as to realize one or more of the following advantages. Hand and wrist protection is provided by the exercise grip when worn on a hand. The protection provided can include protecting the hand and wrist from injury caused by friction when performing exercises on horizontal bars, pull up bars, and/or gymnastics rings. Gripping ability of a person wearing the exercise grip is increased by covering portions of the hand that contact bars or rings during exercise.

Particular embodiments of the subject matter described in this specification can also be implemented so as to realize one or more of the following advantages. Hand and wrist protection is provided by the exercise grip when worn on a hand. The protection provided can include protecting the hand and wrist from injury caused by friction when performing exercises on horizontal bars, pull up bars, and/or gymnastics rings. Gripping ability of a person wearing the exercise grip is increased by covering portions of the hand that contact bars or rings during exercise. The shape of the exercise grips discussed below provide protection along a line of friction that is experienced during gymnastics moves, such as ring muscle ups.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This document discloses several enhanced exercise grips that provide protection to an athlete while performing gymnastics movements, while also allowing for more hand dexterity during other exercises. Some of the exercise grips discussed herein are formed such that the protective portion of the grips are formed along a line of friction that is experienced during gymnastics moves, such as ring muscle ups. As discussed in more detail below, during ring muscle ups, this line of friction is generally felt by athletes along an axis that extends from a location on the side of the palm near the index finger to a location on the opposite side of the palm near to the wrist. Thus, it is important to provide protection across this portion of the palm. However, when an athlete is performing multiple different movements or exercises during a single (sometimes timed) workout, it is also important to provide as much hand dexterity as possible so that the athlete can also grip a weightlifting bar, climb a rope, perform pushups, or perform any number of other exercises while wearing the grips. Furthermore, some grips that are formed from a large portion of material can bunch up during high-repetition gymnastics movements or other exercises, which can cause discomfort during the exercise.

Grips discussed within this document achieve the goals of providing protection along this line of friction experienced while doing gymnastics movements, while also providing sufficient hand dexterity and comfort. The grips disclosed herein achieve these benefits by utilizing a protective portion that is asymmetric along its length. The asymmetric shape is designed so that when the grips are worn by an athlete, portions of the palm are exposed to provide improved dexterity and comfort, while the portion of the palm that experiences the line of friction is covered. Thus, the grips discussed herein provide advantages over prior art grips, as described in more detail below.

Figure 1A:
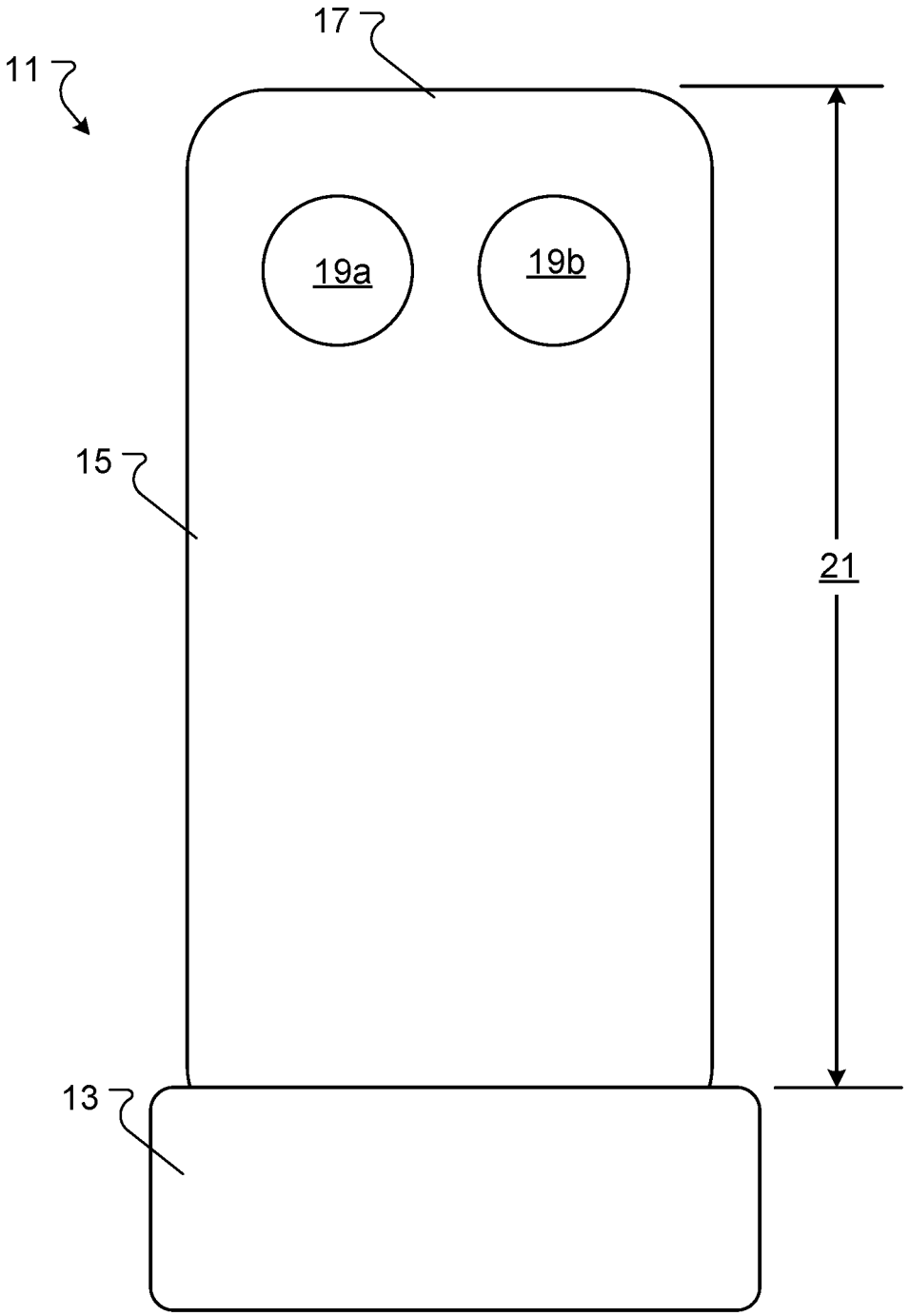
FIG. 1A (Prior Art)
FIG. 1A is an illustration of a prior art two finger gymnastics grip.

FIG. 1A is an illustration of a prior art two finger gymnastics grip 11. The gymnastics grip 11 has a wrist strap 13 and a protective portion 15 that extends from the wrist strap 13 to a finger end 17. The protective portion 15 has two finger holes 19*a*, 19*b* defined therein. The protective portion 15 of the gymnastics grip 11 is generally symmetric along its length 21, and when worn provides no protection for a side of the hand. Rather, the gymnastics grip 11 is generally designed to protect a portion of the palm when worn by a gymnast. Furthermore, the symmetric rectangular nature of the gymnastics grip 11 is generally only designed with gymnastics movements in mind, and is not optimized to be worn when performing other types of exercises, such as Olympic lifts (e.g., power cleans or snatches) that are often performed within a same workout as gymnastics movements (e.g., muscle ups or pull ups) during cross functional training. Furthermore, the rectangular shape of the gymnastics grip 11 can lead to the protective portion bunching up during high repetition gymnastics movements, which can lead to discomfort and/or increased friction.

Figure 1B:
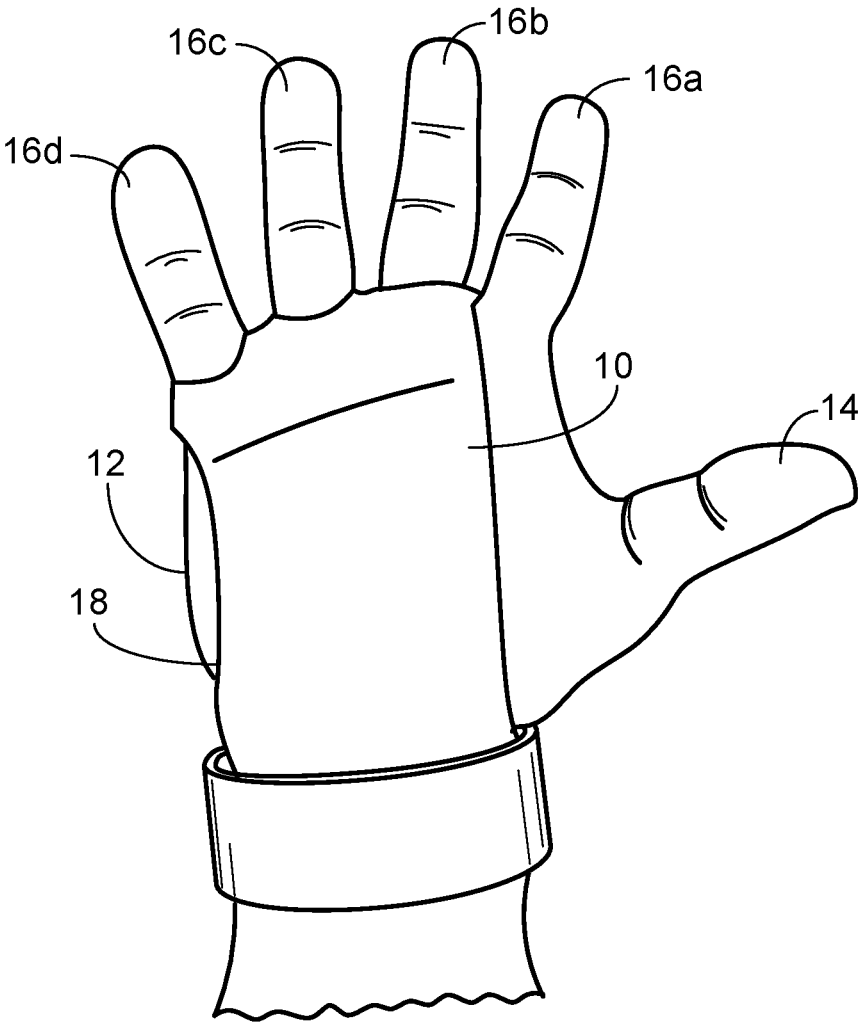
FIG. 1B is a drawing of an example exercise grip on a hand

FIG. 1B is a drawing of an example exercise grip 10 on a hand 12. The grip 10 is formed to protect the hand 12 and wrist 18 of an individual wearing the grip 10, and enhances the individual's grip on a gymnastics bar or rings. As described in more detail below, the grip 10 includes three finger holes that receive a middle finger 16*a*, ring finger 16*b*, and pinky finger 16*c* of the hand 12 when the grip 10 is worn. In some implementations, the index finger 16*d* and thumb 16*e* of the hand 12 remain uncovered when the grip 10 is worn. In some implementations, the exercise grip can include an index finger hole, as described in more detail below.

Figure 2:
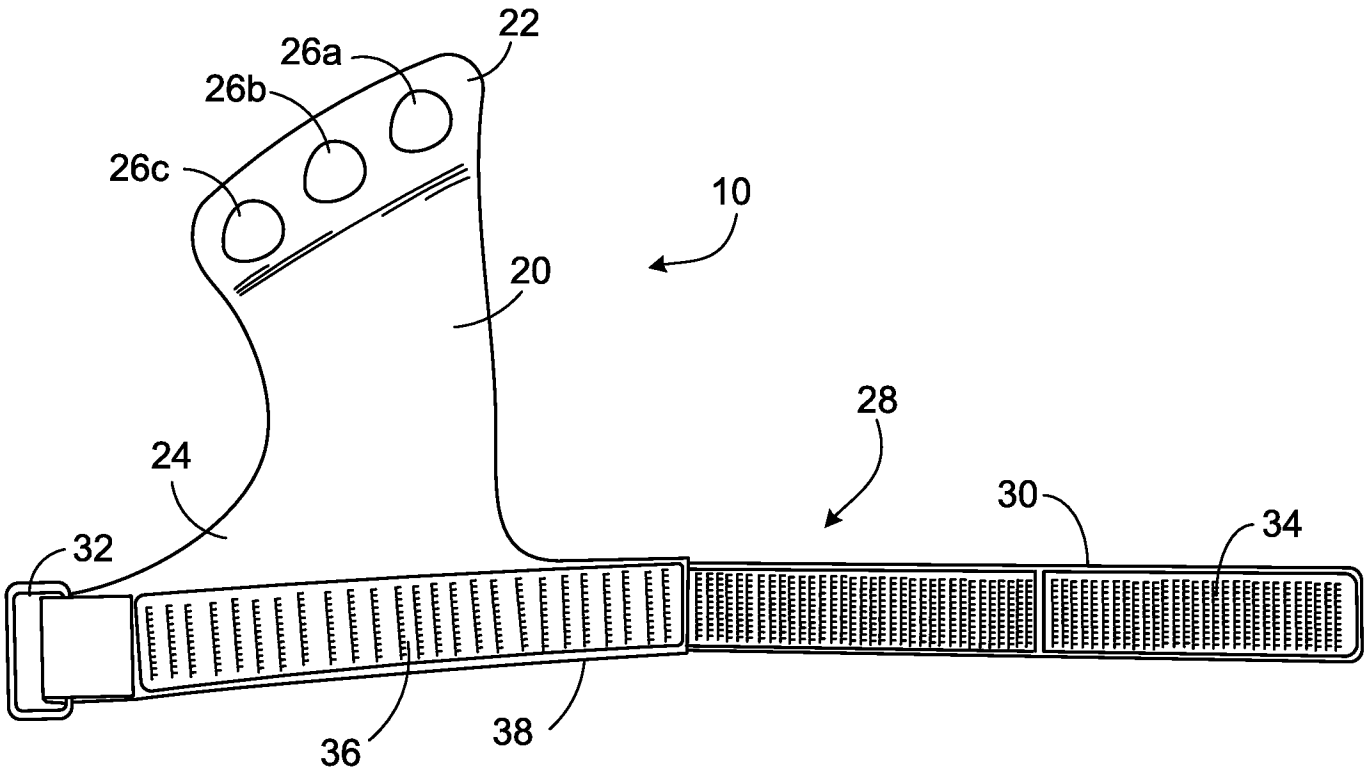
FIG. 2 is another drawing of an example exercise grip.

FIG. 2 is another drawing of an example exercise grip 10. The grip 10 includes a wrist strap 14 and a protective portion 20. The protective portion 20 has a finger end 22 and a wrist end 24 that is connected to the wrist strap 14.

The grip 10 has three finger holes 26*a*, 26*b*, and 26*c* defined therein. The finger holes 26*a*, 26*b*, and 26*c* are defined at the finger end 22 of the protective portion 20. In some implementations, finger hole 26*a* is a middle finger hole that is defined at a location of the protective portion 20 at which a middle finger of a hand is received when the grip 10 is placed on the hand. The finger hole 26*b* is a ring finger hole that is defined at a location of the protective portion at which a ring finger of the hand is received when the grip 10 is placed on the hand. The finger hole 26*c* can be a pinky finger hole that is defined at a location of the protective portion at which a pinky finger of the hand is received with the grip 10 is placed on the hand.

The protective portion 20 can be formed from a continuous piece of flexible material. For example, the protective portion 20 can be made of a high-grade leather or other strong and flexible material allowing appropriate friction and protection. In some implementations, the protective portion 20 can be made of neoprene or a rubber material.

The grip 10 includes a wrist strap 14 for securing the grip 10 about the wrist of an individual. The wrist strap 14 includes a closure strap 30, a cuff 38, and an open loop 32 or wring. In some implementations, the closure strap 30 is located on a side of the grip 10 that will be on a radial side of the wrist when the grip 10 is placed on a hand and the loop 32 is located on a side of the grip 10 that will be on an ulnar side of a wrist when the grip 10 is placed on the hand.

The closure strap 30 can include a hook and loop fastener patch 34 which is adapted to be connected to a corresponding hook and loop fastener patch 36 secured to the portion of the cuff 38 or another portion of the wrist end of the protective portion 20.

Figure 3:
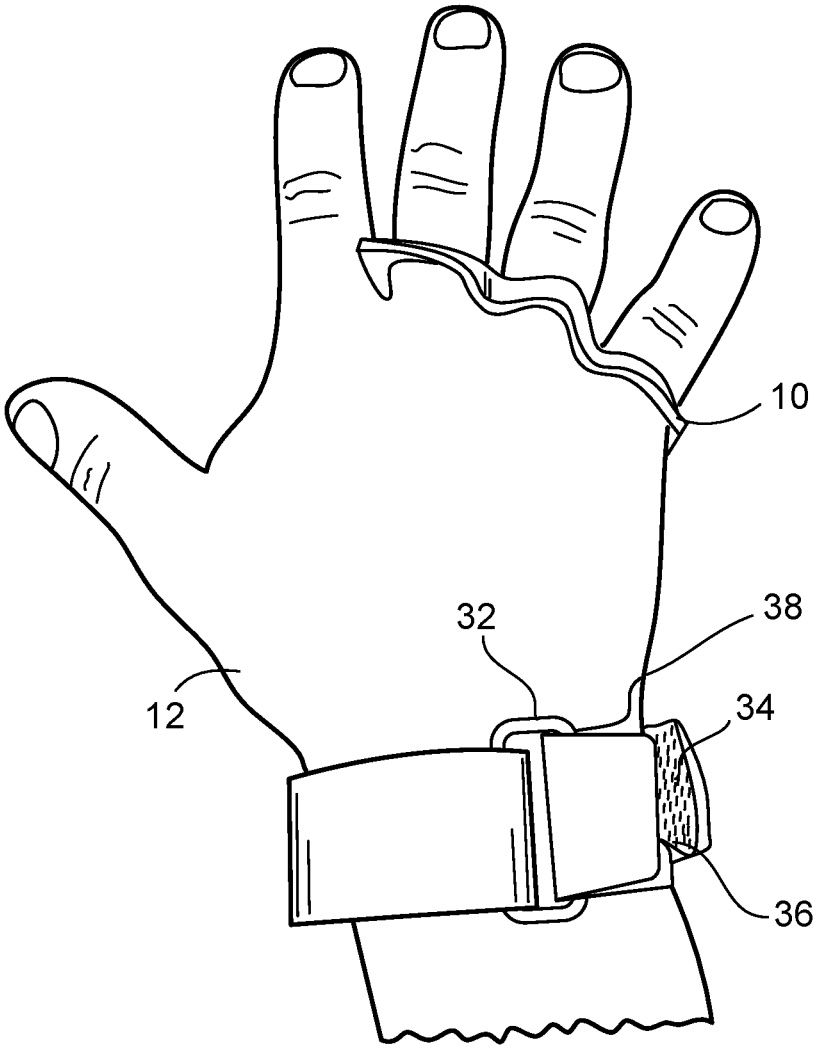
FIG. 3 is a drawing of an example strap assembly for an exercise grip.

As shown in FIG. 3, the closure strap 30 can be fed through the open loop 32 and turned back onto itself to permit the grip 10 to be adjustably fastened to the individual's wrist upon mating the hook and loop fastener patch 34 with the hook and loop fastener patch 36.

Figure 4:
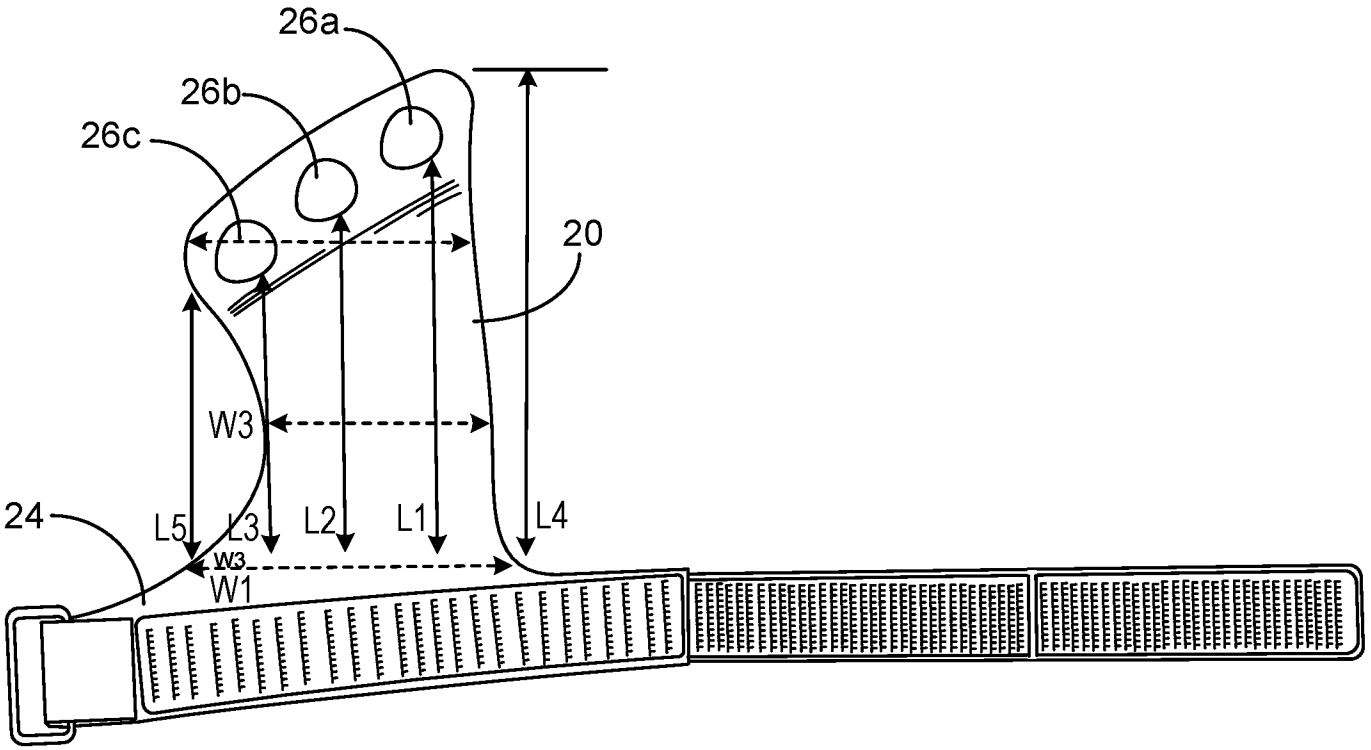
FIG. 4 is another drawing of an example exercise grip.

FIG. 4 is another drawing of an example exercise grip 10, and shows various example lengths and widths of the protective portion 20 of the grip 10. In some implementations, the three finger holes 26*a*, 26*b*, and 26*c* are formed at different distances from the wrist end 24. For example, the finger hole 26*a* can be formed at a first distance L1 from the wrist end 24, the finger hole 26*b* can be formed at a second distance L2 from the wrist end 24, and the finger hole 26*c* can be formed at a third distance L3 from the wrist end 24. In some implementations, the second distance L2 is smaller than the first distance L1 and the third distance L3 is less than the second distance L2. Note that other lengths can be used.

As illustrated by FIG. 4, the length of the protective portion (e.g., as measured from the wrist end 24) varies along the width of the protective portion. For example, the protective portion 10 has a length of L4 near the finger hole 26*a* and smaller length of L5 near the finger hole 26*c*. These varying lengths permit the proper articulation of the hand during exercise.

In some implementations, the protective portion 20 has a width that varies along the length of the protective portion 20. For example, the wrist end 24 can have a first width W1 that covers an ulnar side of a wrist when the grip 10 is worn. The finger end of the grip 10 can have a second width W2 that is smaller than the width W1 of the wrist end 24. The protective portion 20 can also have a third width W3 that is smaller than the width W2. Forming the protective portion 20 to have a width W1 that is larger than each of W2 and W3 allows the wrist end 24 to protect the ulnar side of the wrist, while the width W2 of the finger end permits adequate finger extension and protects the palm immediately under the middle, ring, and pinky fingers. Making the width W3 between the finger end and the wrist end 24 smaller than W1 and W2 increases comfort of the grip 10 and facilitates articulation of the hand.

Figure 5:
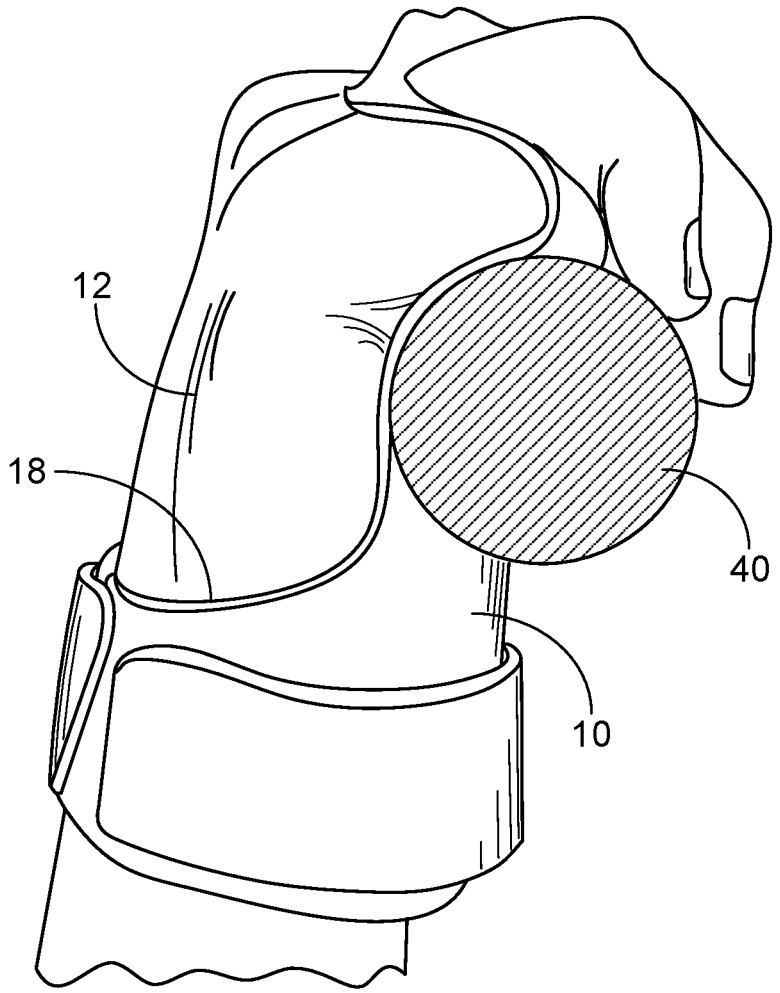
FIG. 5 is a drawing illustrating use of an example exercise grip.

Referring now to FIG. 5, the grip 10 is shown donned on the hand 12 of an individual and being utilized to grip an object, such as a gymnastics ring or bar 40. The construction of the grip 10 permits the individual to grip the ring or bar 40 without having to expend unnecessary energy, while also protecting the portions of the individual's hand 12 and wrist 18 most susceptible to injury, e.g., the area of the palm directly under the middle, ring and little fingers, the middle of the palm and the radial side of the wrist 18.

Figure 6:
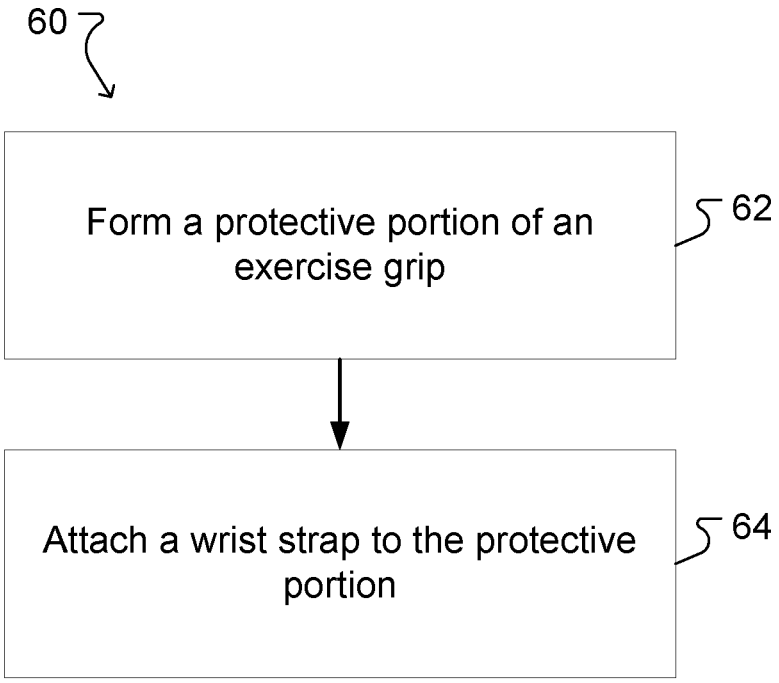
FIG. 6 is a flow chart of an example process for making an exercise grip.

FIG. 6 is a flow chart of an example process 60 for making an exercise grip. In some implementations, the process includes forming a protective portion of an exercise grip (62). The protective portion can be formed, for example, from a continuous piece of flexible material. For example, leather, neoprene, or rubber can be used to form the protective portion.

The protective portion of the exercise grip can be formed, for example, to have a wrist end and a finger end. The finger end can have three finger holes defined therein, as discussed above, or four finger holes defined therein as discussed in more detail below with reference to FIG. 7. For example, the finger end can be formed to have a middle finger hole, a ring finger hole, and a pinky finger hole. The locations of the middle finger hole, ring finger hole, and pinky finger hole can be formed at locations of the protective portion at which a middle finger, ring finger, and pinky finger will be respectively received when the protective portion is placed on a hand. When the finger end is formed to have four holes defined therein, the fourth hold can be formed at a location of the protective portion at which an index finger will be received when the protective portion is placed on the hand.

In some implementations, the middle finger hole is formed at a first distance from the wrist end, the ring finger hole is formed at a second distance from the wrist end, and the pinky finger hole is formed at a third distance from the wrist end. As discussed above, in three finger hole implementations, the middle finger hole can be at a largest distance from the wrist end (e.g., as measured to the center of the middle finger hole), the ring finger can be at a second largest distance from the wrist end (e.g., as measured from the center of the ring finger hole), and the pinky finger hole can be at the shortest distance from the wrist end (e.g., relative to the locations of the middle finger hole and the ring finger hole). In four finger hole implementations, the index finger hole can be further from the wrist end than the middle finger hole. Alternatively, the index finger hole can be formed at a same distance from the wrist end as the middle finger hole or formed at a distance from the wrist end that is between the distance from the wrist end of the middle finger hole and the ring finger hole.

The length of the protective portion extends, for example, from the finger end to the wrist end, and the width of the protective portion can be formed to vary along the length of the protective portion. For example, the protective portion can be formed to have a widest width at the wrist end. The finger end can have a width that is smaller than the width of the wrist end. The protective portion can be formed such that the width of the protective portion can vary between the wrist end and the finger end, with at least one portion of the protective portion having another width that is smaller than the width of the finger end (e.g., as measured at the pinky hole) and smaller than the width of the wrist end.

The process can also include attaching a wrist strap to the protective portion (64). A wrist strap similar to that discussed above with respect to FIG. 3 can be attached to the protective portion. The wrist strap can be attached, for example, by sewing, gluing, or otherwise attaching the wrist strap to the protective portion.

Figure 7:
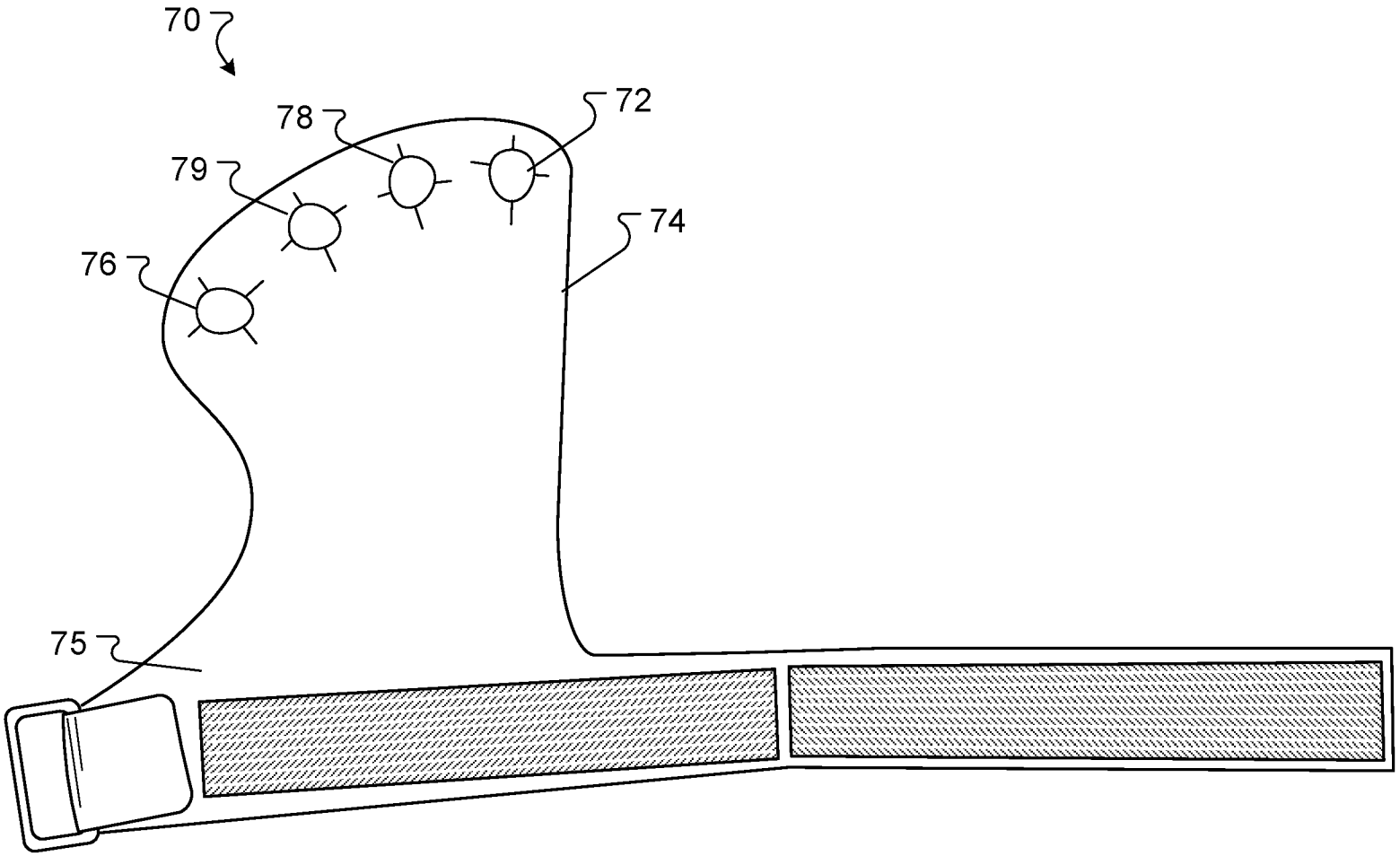
FIG. 7 is another drawing of an example exercise grip.

FIG. 7 is a drawing of another example exercise grip 70. The exercise grip 70 is similar to the exercise grips discussed above, but includes a fourth finger hole 72 that is formed at a location of the protective portion 74 at which the index finger of a hand will be received when the exercise grip 70 is worn. As illustrated by FIG. 7, the length of the protective portion 74 from the wrist end 75 can vary with the distance of the various finger holes. For example, the length of the protective portion 74 corresponding to the index finger hole is longer than the length of the protective portion 74 corresponding to the pinky finger hole 76. As illustrated, the exercise grip 70 also includes a middle finger hole 78 and a ring finger hole 79, which are both formed in a manner similar to that described above.

Figure 8:
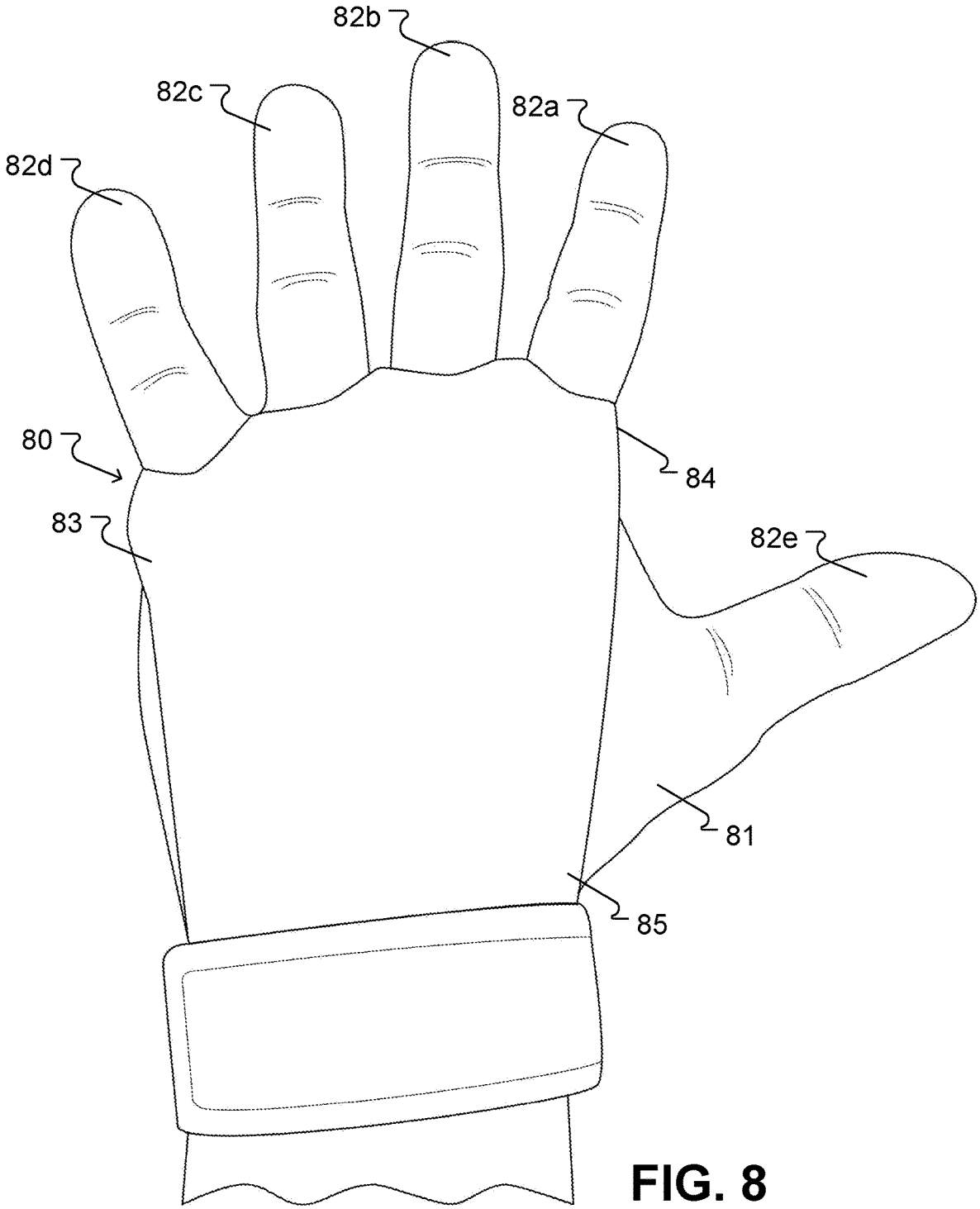
FIG. 8 is another drawing of an example exercise grip on a hand.

FIG. 8 is another drawing of an example exercise grip 80 on a hand 81. As shown in FIG. 8, the grip 80 has four finger holes through which the index finger 82*a*, middle finger 82*b*, ring finger 82*c*, and pinky finger 82*d* are inserted. As illustrated in FIG. 8, the grip 80 does not include a thumb hole, and the thumb 82*e* remains outside of the grip 80. The grip 80 includes a protective portion 83, which is wider at a finger end 84 of the grip than the width of the wrist end 85 of the grip.

Figure 9A:
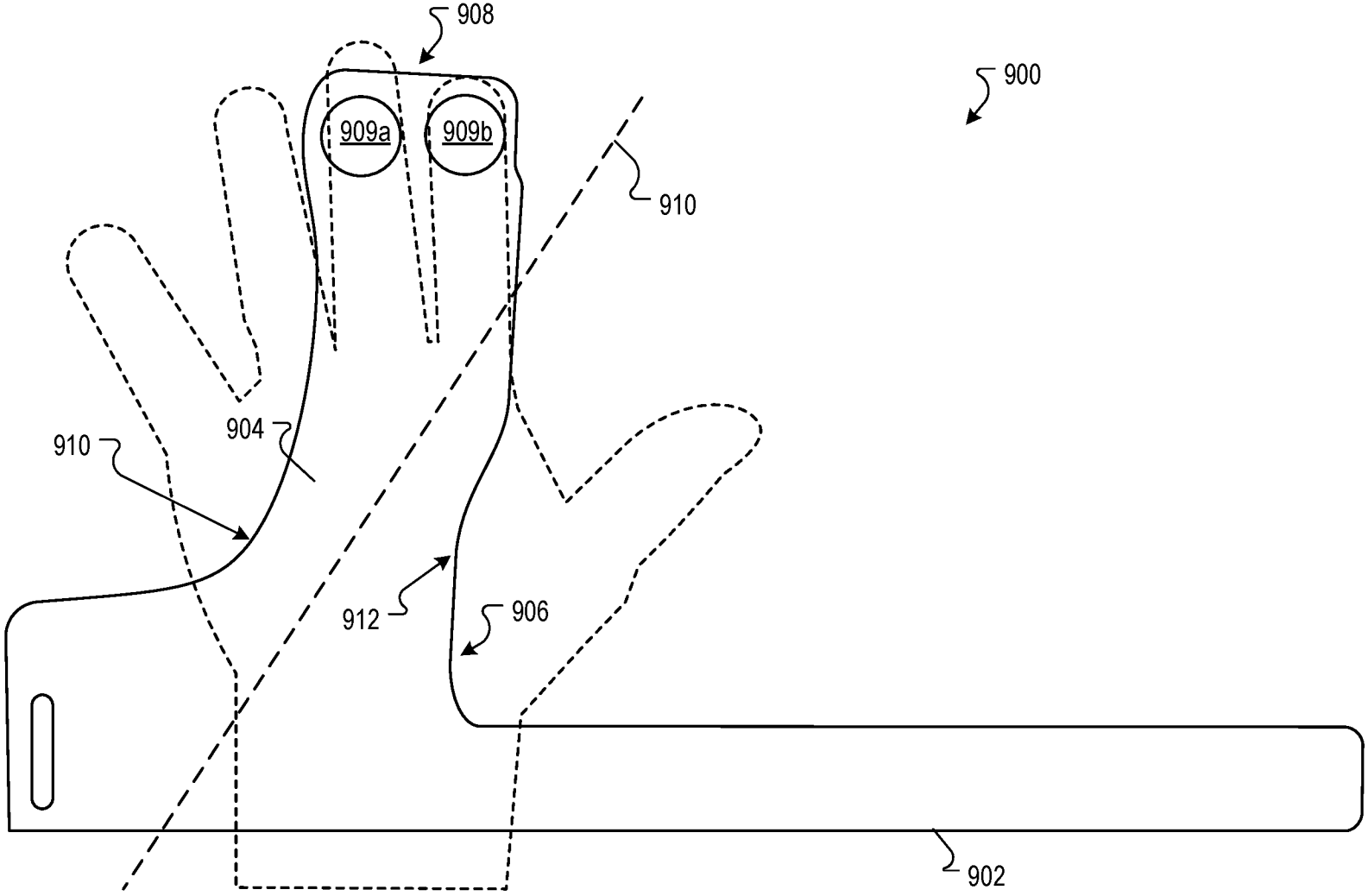
FIG. 9A is a drawing of another example exercise grip.

FIG. 9A is an illustration of an example exercise grip 900 that provides advantages over prior art gymnastics grips. The exercise grip 900 is shown overlaid flat on a palm of a hand, in a similar manner that it would be rest over an athlete's hand. The exercise grip 900 includes a wrist strap 902, and a protective portion 904. The protective portion 904 has a palm end 906 and a finger end 908. The palm end 906 is located closer to the wrist strap 902 than the finger end 908. As will be discussed in more detail with reference to FIG. 9B, although wrist strap 902 and the palm end 906 can be formed from the same continuous piece of material, these are considered two distinct portions of the grip 900 for purposes of describing the grip 900.

As shown in FIG. 9A, the grip 900 has an asymmetric shape along the sides that are between the palm end 904 and the finger end 908. This asymmetric shape has been chosen to provide protection along the line of friction that is experienced when performing some gymnastics movements, such as ring muscle ups, while still allowing for sufficient hand dexterity. For example, using the line 910 as an example line of friction that may be experienced by an athlete during ring muscle ups, FIG. 9A shows that the unique shape of the grip 900 will provide protection against that line of friction represented by the line 910. Meanwhile, the concave shape of the protective portion 904 at arrow 910 allows a large portion of the ulnar side of the palm to remain exposed and the concave shape of the protective portion identified by arrow 912 allows for a large portion of the thenar portion of the hand (i.e., the rounded fleshy part of the hand at the base of the thumb, also referred to as the ball of the thumb) to remain exposed. Leaving these portions of the palm exposed provides for increased dexterity relative to the prior art gymnastic grip 100, as well as increased comfort. As shown, the grip 900 has two finger holes 909*a*, 909*b* that are defined at a location that is closer to the finger end 908 than the palm end 906.

Figure 9B:
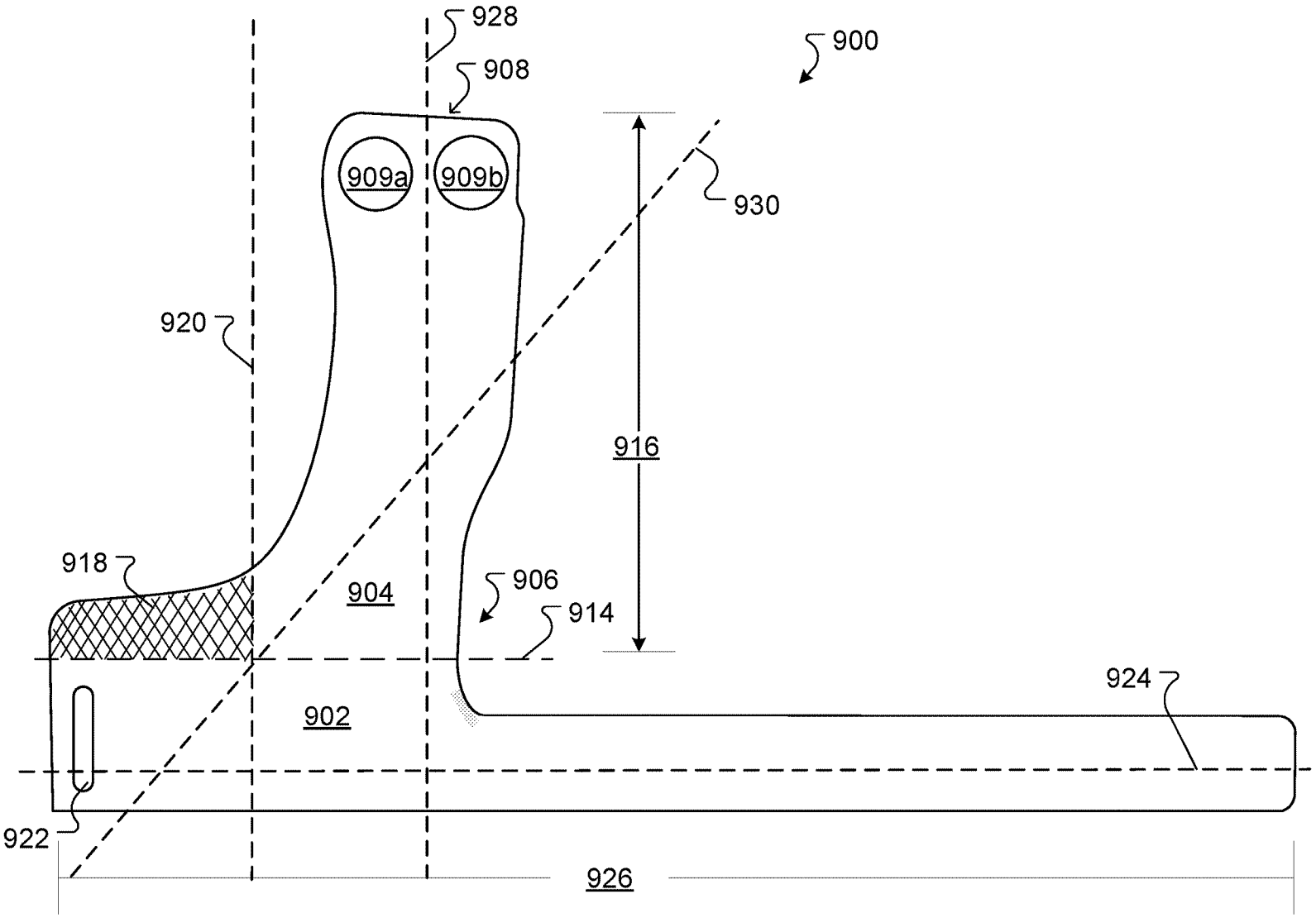
FIG. 9B is another drawing of the example exercise grip of FIG. 9A.

FIG. 9B is an illustration of the example exercise grip 900. FIG. 9B provides more detail as to the different portions of the grip 900, which are used for purposes of describing the shape of the grip 900, and the locations of each portion of the grip 900 with relation to other portions of the grip 900.

The wrist strap 902 of the grip 900 is considered to include the portion of the grip 900 that is shaded (e.g., as delineated from the protective portion by line 914). In some implementations, the palm end 906 of the protective portion meets the wrist strap 902 at the dashed line 914. As noted above, the wrist strap (or at least a portion thereof) can be formed from a same continuous piece of material (e.g., leather, a synthetic material, or another suitable material) as the protective portion 904. However, the wrist strap 902 is formed to wrap around the wrist of an athlete and secure the grip 900 to the wrist of the athlete, while the protective portion 904 is formed to provide protection to areas of the hand between the wrist and the finger tips. Thus, while these two portions of the grip 900 may be formed from the same continuous piece of material, these two portions of the grip are separate and distinct for purposes of describing the grip 900. Furthermore, the entire protective portion 904 can be a single piece of material that extends from the palm end 906 to the finger end 908. In some implementations, multiple pieces of material can be used to create the protective portion 904 and/or wrist strap 902. Additionally, the wrist strap 902 can be formed from the same continuous piece of material as the protective portion 904.

The width of the protective portion 904 varies along the length 916 of the protective portion 904. For example, the width of the palm end 906, where the palm end 906 meets the wrist strap 902, is larger than the width of the finger end 908. The larger width of the palm end 906 includes a side palm protection area 918 (an example side palm protection area shown with crosshatching fill for purposes of illustration). The side palm protection area 918 is formed to wrap around a side of an athlete's palm (e.g., an ulnar side of the palm), while the side of the protective portion opposite the side palm protection area 918 can be formed to expose an opposite side of the athlete's palm. The side palm protection area 918 can be considered to be an area of the protective portion 904 that extends away from the wrist strap 902 (e.g., toward the finger end 908). The width of the side palm protection area 918 can be considered to be the distance between a centerline axis 920 of the palm end 906, and the side of the protective portion 904 on which the hole 922 of the wrist strap is formed. Of course, other reference points and dimensions can be used to identify the side palm protection area 918. The side palm protection area 918 of the grip 900 is shown in FIG. 9B with cross-hatching. It should be noted that in some implementations, the side palm protection area 918 is the only part of the protective portion 904 between the palm end 906 and finger holes 909*a*, 909*b* that wraps around a side of the palm when worn by an athlete.

In some implementations, the side palm protection area 918 is located on an opposite side of the centerline axis 920 of the palm end 906 relative to the location of the finger end 908 of the protective portion 904 and/or one or more of the finger holes 909*a*, 909*b*. For example, as shown in FIG. 9B, the finger end 908 of the protective portion 904 is formed offset from the centerline axis 920 of the palm end 906. That is, as shown in this figure, the finger end 908 is completely formed on the right hand side of the centerline axis 920. Note, however, that in some implementations, the finger end 908 could be formed to cross over the centerline axis 920 at least partially.

The location of the centerline axis 920 can be located, for example, at a midpoint of the width of the protective portion 904 at the palm end 906. The centerline axis 920 can be defined, for example, as an axis that is perpendicular (or substantially perpendicular) to a wrist strap axis 924. The wrist strap axis, illustrated by the line 924, can be defined by the length 926 of the wrist strap 902, which is generally perpendicular to the length 916 of the protective portion. As used herein, the length 926 of the wrist strap 902 is considered to be the longest dimension of the wrist strap 902. Note that as used herein the terms length and width are merely descriptive terms, and are being used with reference to the drawings. As such, the length of one element is not necessarily along a same axis or in a same direction as the length of another element.

In some implementations, as the material of the protective portion 904 extends away from the palm end 906, the material of the protective portion 904 no longer extends along the centerline axis 920 of the palm end 906 but rather extends along a finger end axis 926. For example, as shown in FIG. 9B, the finger end 908 of the protective portion 904 is formed over the finger end axis 928, and offset from (e.g., not overlapping) the centerline axis 920 of the palm end 906. In some implementations, the finger end axis 928 can be parallel (or substantially parallel) to the centerline axis 920. For example, the finger end axis 928 can be an axis that passes between the two finger holes 909*a*, 909*b* and is parallel to the centerline axis 920. The finger end axis 928 can be perpendicular (or substantially perpendicular) to the wrist strap axis 922.

The shift of the protective portion 904 from the centerline axis 920 to the finger end axis 928 can occur along an angled friction axis 930, as shown in FIG. 9B. For example, as the protective portion 904 extends away from the wrist strap 902, the protective portion moves is formed in a direction away from the centerline axis 920, and toward the finger end axis 928. In some implementations, the material of the protective portion 904 can be formed along an angled friction axis 930 that intersects both of the centerline axis 920 and the finger end axis 928. Generally, the angled friction axis 930 will not be perpendicular to the centerline axis 920. In some implementations, the angled friction axis 930 is not perpendicular to the finger end axis 928.

The section of the protective portion 904 where the material of the protective portion 904 shifts from the centerline axis 920 to the finger end axis 928 can be referred to as an angled friction protection section. The angled friction protection section can vary in width, and a narrowest part of the protective portion 904 can be located in the angled friction protection section to enhance the dexterity of the hand while wearing the grip 900 (e.g., exposing more of the hand on either side of the grip 900).

Figure 9C:
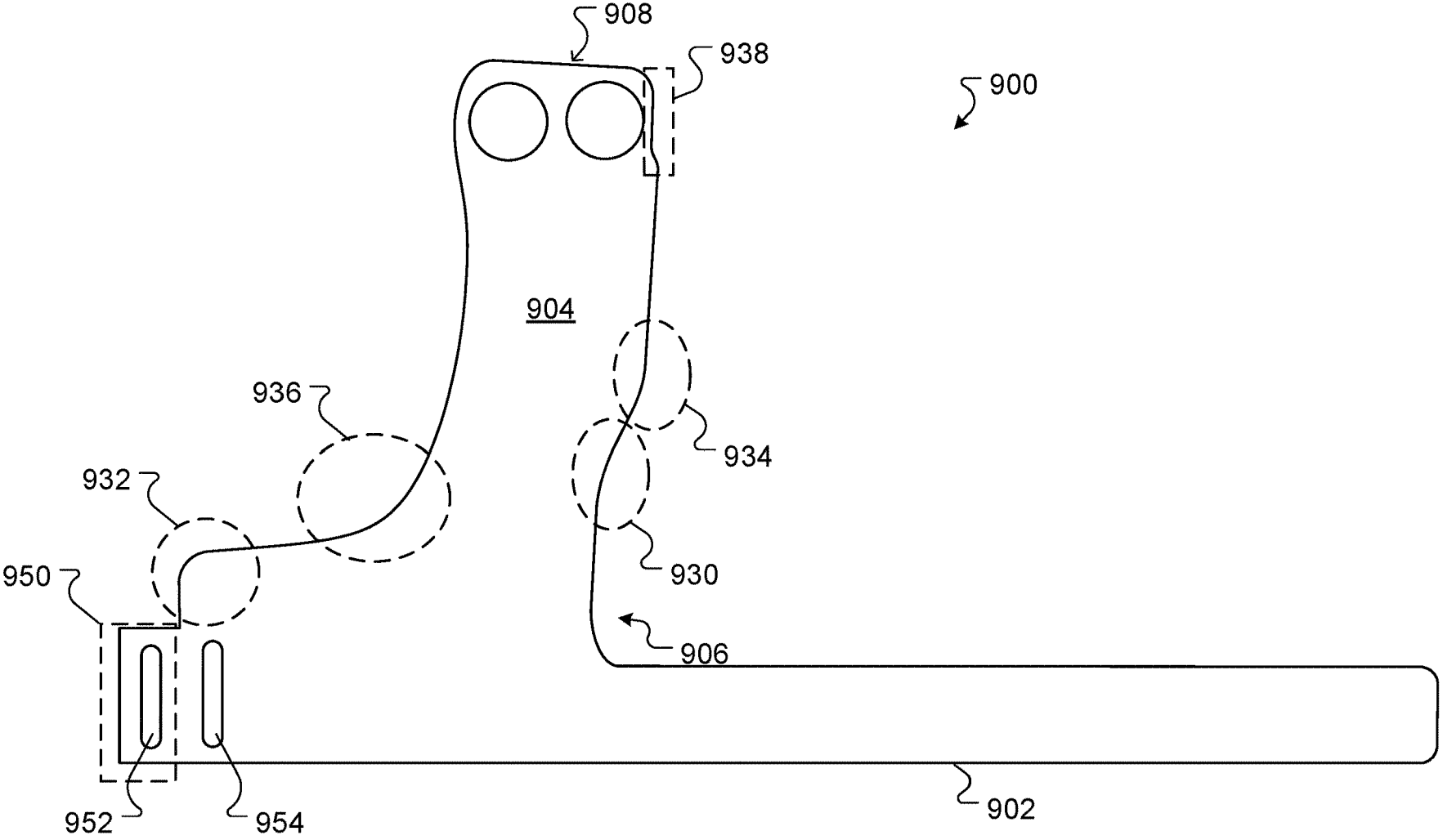
FIG. 9C is another drawing of the example exercise grip of FIGS. 9A and 9B.

FIG. 9C is another illustration of the example grip 900. As shown in FIG. 9C, one given side of the grip 900 has concave segment 930, while the other side of the grip 900 has a convex segment 932. Meanwhile, the one given side of the grip 900 also has a convex segment 934, and the other side of the grip 900 also has a concave section. As such, each side of the grip 900 can have a concave segment and/or a concave segment. In some implementations, each side of the grip 900 can have both a concave segment and a convex segment (e.g., 930 and 934 or 932 and 936). The concave and/or convex sections on each side can each be located between the palm end 906 and the finger end 908 of the protective portion 904. These concave and/or convex segments are arranged to expose various portions of the palm, while providing protection along the line of friction (e.g., the friction axis of FIG. 9B) that is experienced during various gymnastics movements, such as ring muscle ups.

The protective portion 904 of the grip 900 narrows on one side near the finger end 908. For example, as highlighted by the box 938, a given segment of the right side of the protective portion 904 is inset (e.g., made more narrow) than the previous segment of the protective portion 904 that is closer to the palm end 906. This inset identified by box 938 is included to provide comfort when the grip 900 is worn on a middle finger and a ring finger. That is, when the finger holes 909*a* and 909*b* are placed over the middle finger and the ring finger, the inset 938 provides additional room for the index finger, thereby reducing friction and discomfort that might otherwise be experienced when the finger holes 909*a*, 909*b* are placed over the middle finger and ring finger. Of course, the finger holes 909*a*, 909*b* can be placed over the index finger and the middle finger rather than the index finger and ring finger.

The view of the grip 900 in FIG. 9C, is a view of an implementation of the grip 900 prior to completion of the manufacturing process. Specifically, the wrist strap 902 is shown more elongated on the left hand side (e.g., in box 950), and with two holes 952*a*, 952*b* defined therein, whereas FIGS. 9A and 9B showed a single hole and less elongated wrist strap. During manufacturing, the elongated portion 950 of the wrist strap 902 can be folded over to align the holes 952, 954, and the elongated portion 950 can be sewn (or otherwise attached) to the remainder of the wrist strap 902, thereby creating a thicker portion of the wrist strap 902. This thicker portion of the wrist strap 902 enhances the comfort of the grip 900 by eliminating the need to use a plastic ring (or any other material ring, such as metal), to fasten the wrist strap 902 around a wrist. For example, the opposite side of the wrist strap 902 (e.g., the right side) can be fed through the aligned holes 952, 954 (after folding and attaching the elongated portion 950 to the remainder of the wrist strap), and then secured for example, using a hook and loop fastener that is attached to the wrist strap 902.

Figure 10:
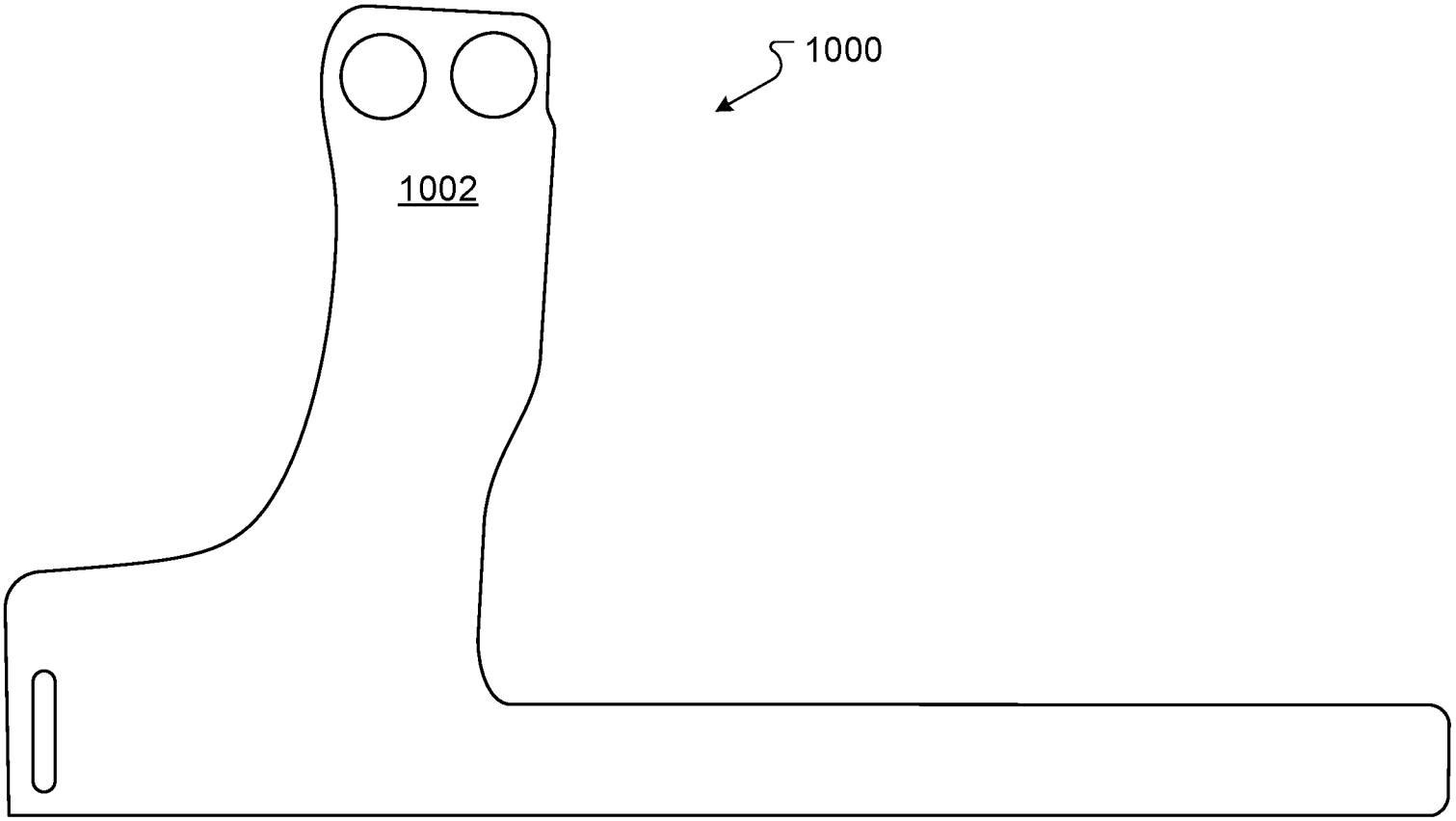
FIG. 10 is an illustration of another example exercise grip

FIG. 10 is an illustration of another exercise grip 1000. The exercise grip 1000 is substantially similar to the exercise grip 900 described above, but also includes a dowel portion 1002. The dowel portion 1002 is a thicker area of the protective portion that functions to provide a dowel effect when gripping a bar. The dowel portion 1002 can be formed, for example, by attaching one or more additional layers of protective portion to the grip 1000. Alternatively, the protective portion could be formed (e.g., cut) in a manner that provides for a thicker section of protective portion, which would define the dowel portion 1002.

Figure 11:
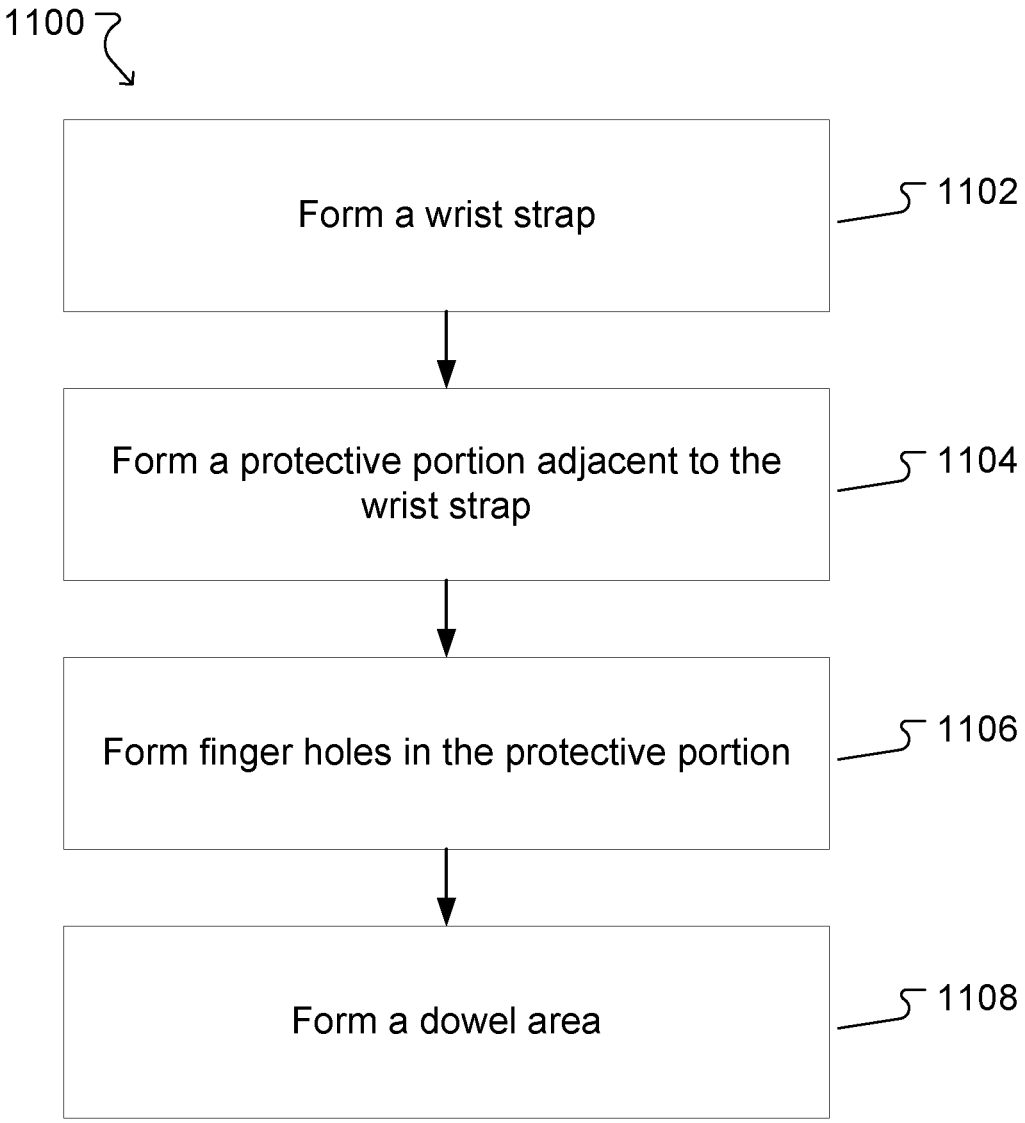
FIG. 11 is a flow chart of an example method for producing an exercise grip.

FIG. 11 is a flow chart of an example method 1100 of forming a gymnastics grip. A writ strap is formed (1102). In some implementations, the wrist strap can be formed by cutting (or otherwise shaping) a portion of material to have a strap length and a mechanism that receives an end of the strap length, as discussed above and shown in the figures.

A protective portion is formed (1104). The protective portion can be formed to have a palm end and a finger end. The palm end is located closer to the wrist strap than the finger end, and the finger end is formed offset from a centerline axis of the palm end of the protective portion. In some implementations, the palm end is formed adjacent to the wrist strap. A width of the palm end of the protective portion can be formed to be larger than the width of the finger end of the protective portion.

A friction axis can be defined by an angled friction protection section of the protective portion that is formed. In some implementations, the protective portion is forms so that the friction axis intersects the centerline axis of the palm end and a finger end axis that is defined between two finger holes of the finger end, as illustrated in FIG. 9B. The finger end axis can be parallel to the centerline axis of the palm end. In some implementations, the protective portion is formed so that the friction axis defined by the angled friction protection section of the protective portion is not perpendicular to the centerline axis of the palm end. The angled friction protection section is formed to have a width that varies long the length of the angled friction protection section, as shown for example in FIG. 9C.

The width of the protective portion can be formed to be most narrow at a location within the angled friction protection section. The protective portion can be formed so that the finger end axis is perpendicular to a wrist strap axis that is defined by a largest dimension of the wrist strap, as shown in FIG. 9B. The protective portion can be formed so that the palm end centerline axis can be perpendicular to the wrist strap axis and can bisect the palm end of the protective portion.

The protective portion can be formed from a single piece of material that extends from the palm end to the finger end. For example, the single piece of material can be leather, a synthetic material, or another suitable material. The protective portion can be formed to include a side palm protection area that extends from the wrist strap toward the finger end and is located on an opposite side of the centerline axis of the palm end than the two finger holes.

The protective portion can be formed to include a first concave segment of a first side, which can also be referred to as a reference side, of the protective portion that has a concave shape between the wrist strap and the finger end. The protective portion can also be formed with a first convex segment of a second side, which can also be referred to as an opposite side, of the protective portion having a convex shape between the wrist strap and the finger end.

The first side of the protective portion can be formed to have the first concave segment and a second convex segment that are both between the palm end and the finger end. The second side of the protective portion is formed to have a second concave segment and the first convex segment that are both between the palm end and the finger end.

Finger holes can be formed in the protective portion (1106). In some implementations, two finger holes are formed in the protective portion. In these implementations, the two finger holes can be formed at a location of the protective portion that is closer to the finger end than the palm end. Of course, as discussed above, three or four finger holes could be formed in the protective portion depending on the application or desired number of finger holes.

In some implementations, the protective portion can be formed to have one side that narrows at a given segment that is adjacent to the two finger holes. The narrowing width of the given segment can be relative to the width of the protective portion that is closer to the palm end.

In some implementations, the grip is formed so that at least a portion of the wrist strap and the protective portion are both formed using a same piece of continuous material. A portion of the wrist strap can have two holes defined therein, for example, as shown by FIG. 9C. The portion of the wrist strap having the two holes defined therein can be folded over to align the two holes, and the two holes can be defined to receive an opposite end of the wrist strap when aligned. For example, the size of the two holes can be slightly larger than the opposite end of the wrist strap.

In some implementations, the two sides (e.g., the reference side and the opposite side) of the protective portion that extend from the palm end to the finger end are formed to be asymmetric and cover only a portion of the palm when placed on a hand.

A dowel area can be formed on the protective portion (1108). The dowel area can be formed at a location of the protective portion that is between the finger holes and the palm end of the protective portion. In some implementations, the the dowel portion is formed to be a thicker area of the protective portion that functions to provide a dowel effect when gripping a bar. The dowel portion can be formed, for example, by attaching one or more additional layers of protective portion to the grip. Alternatively or additionally, the protective portion could be formed (e.g., cut) in a manner that provides for a thicker section of protective portion, which would define the dowel portion.

What is claimed is:

1. An exercise grip, comprising:

a wrist strap having an open loop on one side, wherein the open loop is configured to receive an opposite end of the wrist strap; and a protective portion that has a palm end and a finger end, wherein:

the palm end is located closer to the wrist strap than the finger end;

a first width of the palm end is larger than a second width of the finger end;

a first side of the protective portion is closer to the open loop than a second side of the protective portion;

the first side of the protective portion is configured to cover a portion of an ulnar side of a hand when the wrist strap is affixed to a wrist with the open loop on the ulnar side of the hand;

the second side of the protective portion is configured to be closer to a thumb of the hand when the wrist strap is affixed to a wrist with the open loop on the ulnar side of the hand;

a first convex segment defined by a first edge of the first side of the protective portion is closer to the wrist strap than a first concave segment of the first side defined by the first edge of the first side of the protective portion; and a second convex segment defined by a second edge of the second side is closer to the finger end than the first concave segment of the first side;

the second width of the finger end is measured at a location of a first axis that (i) is parallel to a bottom edge of the wrist strap located between the first side and the second side, and (ii) passes through a vertex of the second convex segment;

a vertex of the first convex segment is located outside of (i) a rectangular plane defined by the first axis, (ii) the bottom edge of the wrist strap located between the first side and the second side, (iii) a first side axis orthogonal to the bottom edge of the wrist strap and extending between the bottom edge of the wrist strap and a first intersection point of the first axis with the first side, and (iv) a second side axis orthogonal to the bottom edge of the wrist strap and extending between the bottom edge of the wrist strap and a second intersection point of the first axis with the vertex of the second convex segment; and a vertex of a second concave section defined by the second edge of the second side is (i) closer to the palm end than the second convex segment of the second side and (ii) inside the rectangular plane.

2. The exercise grip of claim 1, wherein a friction axis is defined by an angled friction protection section of the protective portion, wherein the friction axis intersects the centerline axis of the palm end and a finger end axis that is defined between two finger holes of the finger end, wherein the finger end axis is parallel to the centerline axis of the palm end, and wherein the friction axis is not perpendicular to the centerline axis of the palm end.

3. The exercise grip of claim 2, wherein the width of the protective portion is most narrow at a location within the angled friction protection section.

4. The exercise grip of claim 2, wherein:

the finger end axis is perpendicular to a wrist strap axis that is defined by a largest dimension of the wrist strap; and the centerline axis of the palm end is perpendicular to the wrist strap axis and bisects the palm end of the protective portion.

5. The exercise grip of claim 4, wherein:

the protective portion is a single piece of material that extends from the palm end to the finger end;

the protective portion includes a side palm protection area that extends from the wrist strap toward the finger end and is located on an opposite side of the centerline axis of the palm end than the two finger holes.

6. The exercise grip of claim 4, wherein the angled friction protection section has a width that varies along the length of the angled friction protection section.

7. The exercise grip of claim 1, wherein the protective portion has two finger holes that are defined at a location of the protective portion that is closer to the finger end than the palm end.

8. The exercise grip of claim 7, wherein one side of the protective portion narrows at a given segment that is adjacent to the two finger holes relative to the width of the protective portion that is closer to the palm end.

9. The exercise grip of claim 1, wherein the first side and the second side of the protective portion that extend from the palm end to the finger end are asymmetric and cover less than all of a palm when placed on a hand.

10. The exercise grip of claim 1, further comprising a dowel area that is located between the finger end and the palm end.

11. The exercise grip of claim 1, wherein the first side of the protective portion includes a first side of the palm end that extends further away from a centerline of the finger end than an opposite side of the palm end.

12. The exercise grip of claim 1, wherein at least two finger holes are located between the finger end and the palm end.

13. The exercise grip of claim 1, wherein a portion of the second edge that connects the vertex of the second convex segment and the vertex of the second concave section is within the rectangular plane.

14. The exercise grip of claim 1, wherein an edge of the protective portion at the finger end is a continuous edge that connects the first side and the second side.

15. The exercise grip of claim 1, wherein a top edge of the protective portion that is most distal from the palm end has a continuous linear portion between two arcs that provide a transition to the first side and the second side.

* * * * *